US005535911A

United States Patent [19]

Cortez

[11] Patent Number: 5,535,911

[45] Date of Patent: Jul. 16, 1996

[54] OPENING DEVICE FOR CANS

[76] Inventor: Alejandro Cortez, c/o Daniel T. Ebihara, 91 Grand St., New York, N.Y. 10013

[21] Appl. No.: 297,378

[22] Filed: Aug. 29, 1994

[51] Int. Cl.[6] ..... B65D 17/32

[52] U.S. Cl. ..... 220/268; 220/266

[58] Field of Search ..... 220/263, 266, 220/268

[56] References Cited

U.S. PATENT DOCUMENTS

| | | | |
|---|---|---|---|
| D. 306,124 | 2/1990 | Hoilien . | |
| 3,779,417 | 12/1973 | Klein | 220/268 |
| 3,954,030 | 5/1976 | Newton . | |
| 3,980,201 | 9/1976 | Keiji . | |
| 4,155,480 | 5/1979 | Debenham et al. | 220/268 |
| 4,196,823 | 4/1980 | Madden et al. | 220/268 |
| 4,305,523 | 12/1981 | Dalli et al. | 220/268 |
| 4,311,249 | 1/1982 | Joyce | 220/268 |
| 4,356,929 | 11/1982 | Müller-Kühn . | |
| 4,466,313 | 8/1984 | Gardner . | |
| 4,530,260 | 7/1985 | Holka . | |
| 4,585,140 | 4/1986 | Lambert et al. | 220/268 |

*Primary Examiner*—Allan N. Shoap
*Assistant Examiner*—Stephen Cronin
*Attorney, Agent, or Firm*—Richard L. Miller

[57] ABSTRACT

A can opener device, mounted on a can top, comprising a front portion, a top portion and a rear portion. The front portion having a pair of front portion tear edges, which can be severed by applying pressure. The rear portion having a u-bend where pressure is applied to sever the front portion tear edges. The top portion attached to the front portion and to the rear portion, the top portion in a plane above the can top, pressure applied to the top portion pushes the front portion into the can after the front portion tear edges are severed. The can top comprises a plurality of rings, each having a thin portion and a thick portion.

13 Claims, 3 Drawing Sheets

FIG. 1
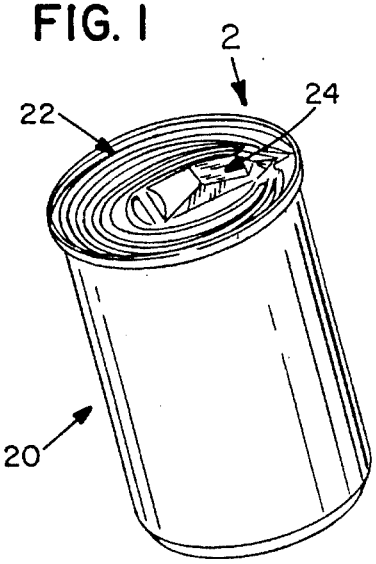
FIG. 2
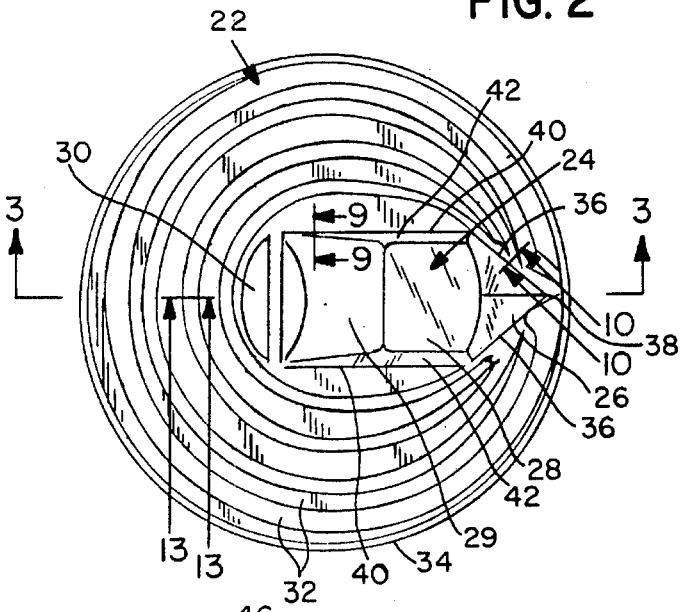
FIG. 3
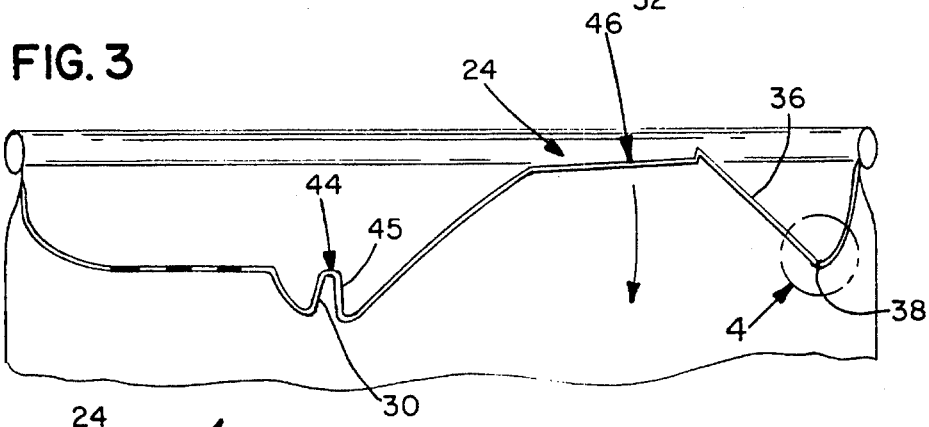
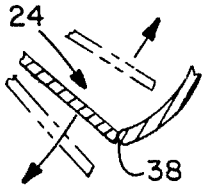
FIG. 4
FIG. 5
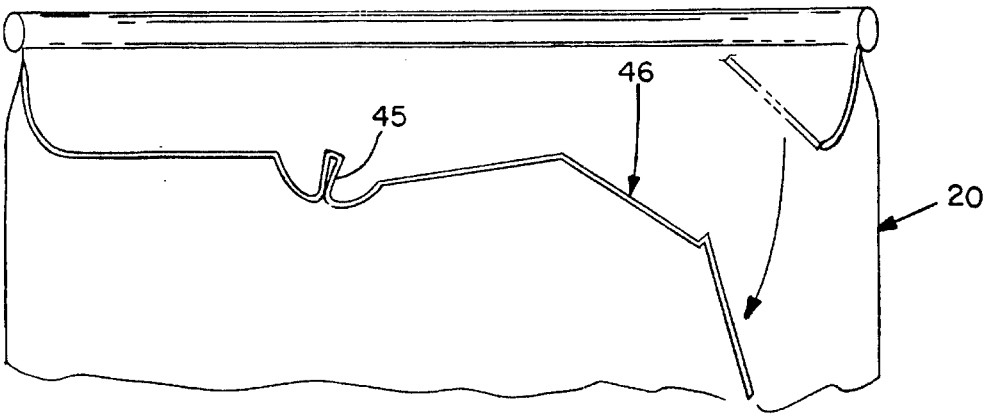

FIG. 11
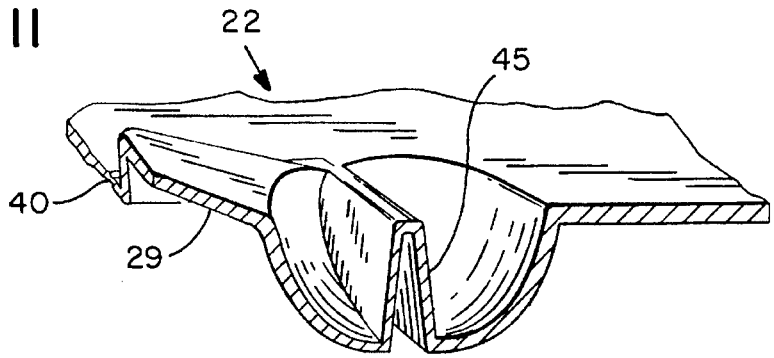
FIG. 12
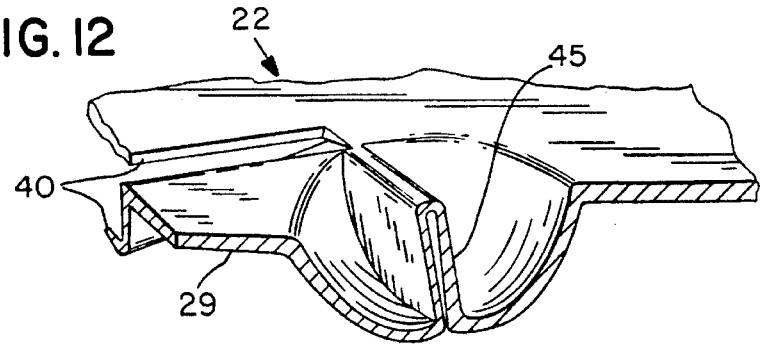
FIG. 13
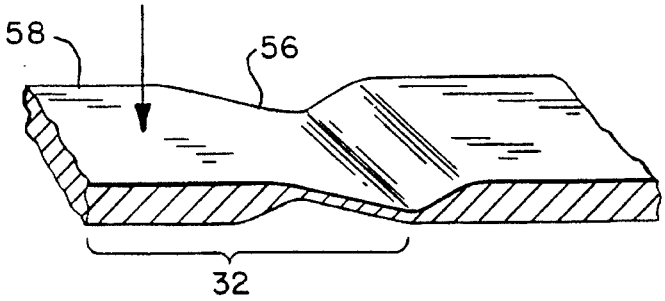
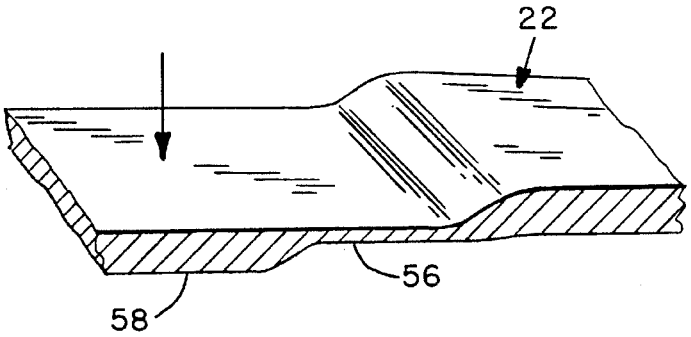
FIG. 14
FIG. 15
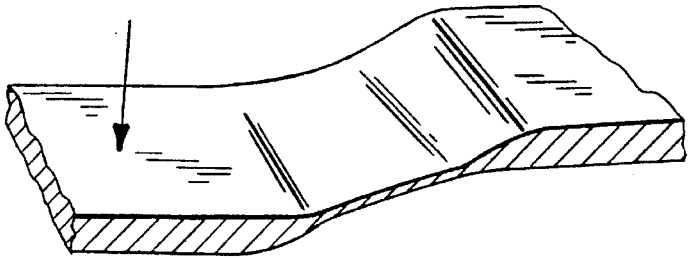

OPENING DEVICE FOR CANS

BACKGROUND OF THE INVENTION

The invention relates to an opening device for cans. More particularly, the invention relates to a device on a can, for creating an opening for dispensing the contents of the can.

Conventional can opening devices have several limitations. Typically, they have a tab, attached to the can with a rivet. The tab has a lever portion, and an opener portion. Operation of the can opener requires a person to use their fingernail to pry up the lever portion a sufficient distance to allow them to grip the tab and open the can. Broken fingernails, and aching fingers can result, especially when several cans must be opened. Many people simply lack the strength and dexterity to open these cans.

U.S. Pat. No. 3,954,030 to Newton, discloses a hand-held fulcrum type can opener.

U.S. Pat. No. 3,980,201 to Keiji, discloses a pop-top can lid of a type using a pull tab.

U.S. Pat. No. 4,356,929 to Muller-Kuhn et al., discloses a pop-top lid that is mounted for slidably moving along the edges of a preformed opening.

U.S. Pat. No. 4,466,313 to Gardner, discloses a finger tip mounted opener, which has a flattened portion for engaging a tab on a beverage can, for opening the can.

U.S. Pat. No. 4,530,260 discloses an opener tool, for easing operation of standard opener tabs.

U.S. Pat. No. Des. D306,124, discloses a beverage opener tool.

While these units may be suitable for their intended purposes, or for general use, they would not be as suitable for the purposes of the present invention as hereafter disclosed.

SUMMARY OF THE INVENTION

It is an object of the invention to produce a can opening device that allows a can to be opened easily.

It is another object of the invention to produce a can opening device that prevents injury to a person opening a can bearing the device.

It is a further object of the invention to produce a can opening device that allows a person with limited strength and dexterity to open a can bearing the device.

The invention is a can opener device, mounted on a can top, comprising a front portion, a top portion and a rear portion. The front portion having a pair of front portion tear edges, which can be severed by applying pressure. The rear portion having a u-bend where pressure is applied to sever the front portion tear edges. The top portion attached to the front portion and to the rear portion, the top portion in a plane above the can top, pressure applied to the top portion pushes the front portion into the can after the front portion tear edges are severed. The can top comprises a plurality of rings, each having a thin portion and a thick portion.

To the accomplishment of the above and related objects, the invention may be embodied in the form illustrated in the accompanying drawings. Attention is called to the fact, however, that variations are contemplated as being part of the invention, limited only by the scope of the claims.

BRIEF DESCRIPTION OF THE DRAWINGS

In the drawings, like elements are depicted by like reference numerals throughout the several views. The drawings are briefly described as follows:

FIG. 1 is a diagrammatic perspective view of a can with the instant invention installed thereon.

FIG. 2 is an enlarged top plan view, taken in the direction of arrow 2 in FIG. 1.

FIG. 3 is an enlarged cross sectional view, taken on line 3—3 in FIG. 2.

FIG. 4 is a still further enlarged cross sectional view, with parts broken away in the area indicated by arrow 4 in FIG. 3, illustrating a separation.

FIG. 5 is an enlarged cross sectional view, similar to FIG. 3, but illustrating the lid partially separated, and forced into the can.

FIG. 11 is an enlarged diagrammatic perspective partial view before pressure is applied to a first point.

FIG. 12 is an enlarged diagrammatic perspective partial view after pressure is applied to the first point.

FIG. 13 is a greatly enlarged diagrammatic cross sectional view with parts broken away, taken on line 13—13 of FIG. 2, before pressure is applied to the lid.

FIG. 14 is a greatly enlarged diagrammatic cross sectional view with parts broken away, taken on line 13—13 of FIG. 2 after pressure is applied to the lid at the first point.

FIG. 15 is a greatly enlarged diagrammatic cross sectional view with parts broken away, taken on line 13—13 of FIG. 2, after pressure is applied to the lid at the second point.

DETAILED DESCRIPTION OF THE PREFERRED EMBODIMENTS

Figure 6:
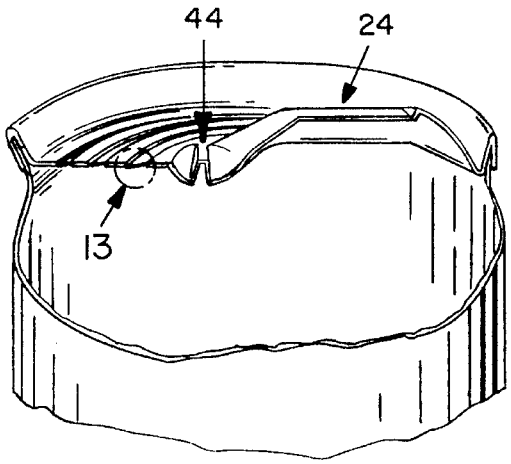
FIG. 6 is an enlarged fragmentary perspective view, showing a first point, where downward pressure is first to be applied.

FIG. 1 illustrates a can 20, having a top 22. A can opening device 24 is located at the can top 22.

FIG. 2 is an enlarged plan view, detailing the can top 22 and the can opening device 24 mounted thereon. The can opening device has a front portion 26, a top portion 28, a mid portion 29 and a rear portion 30. The mid portion extends from the top portion 28, downward toward the rear portion 30. The can opening device is surrounded by a series of rings 32, which alternate in thickness. The can 20 also has an outer rim 34, which is standardly present on cans containing liquids.

The front portion 26 has a pair of front portion tear edges 36, which come to a point 38. The point 38 is closer to the outer rim 34 than the other parts of the can opening device 24. A pair of side tear edges 40, extend from the front portion tear edges 36 to the rear portion 30.

Side portions 42, extend from the side tear edges 40 upward toward the top portion 28, so that the top portion 28 is in a plane raised above the can top 22.

FIG. 3 is a further enlarged cross sectional detail of the can opening device 24. A first pressure point 44 is at the rear portion 30 where the rear portion 30 has a U-bend 45, a second pressure point 46 is at the top portion 28, as illustrated in FIG. 3.

When pressure is applied to a first pressure point 44, The front portion 36 of the can-opening device 24 severs from the can top 22, starting at the point 38, and continuing along the front portion tear edges 36, a detail of which is illustrated in FIG. 4. Pressure is then applied to the second pressure point 46, at the top portion 28, which allows the front portion tear edges 36 and the side tear edges 40 to tear completely. With continued pressure at the second pressure point 46, the U-bend 45 kinks, and a major portion of the can opening device 24 is pushed into the can 20. FIG. 5 illustrates the motion of the can opening device 24 as it is pushed into the can 20 from its former position, shown in phantom.

Figure 7:
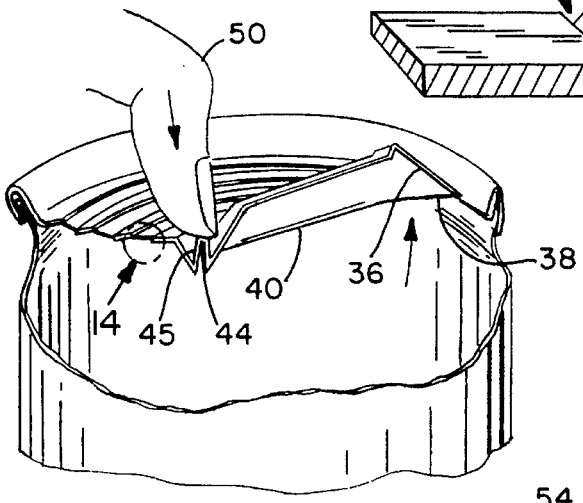
FIG. 7 is an enlarged fragmentary perspective view, illustrating that when further pressure is applied a front portion is forced upwards separating from the can.
Figure 8:
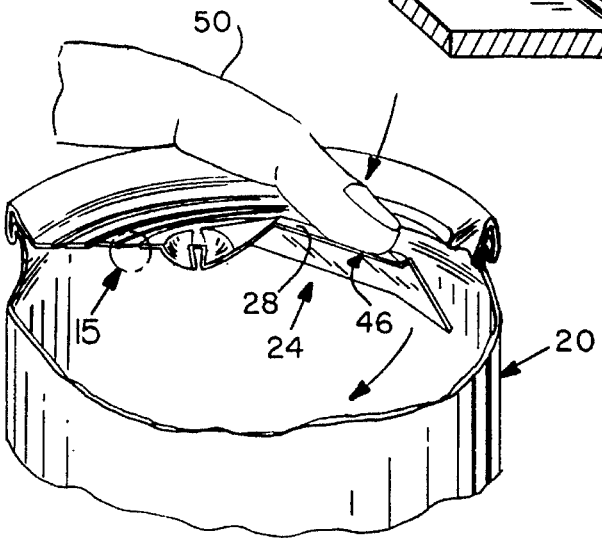
FIG. 8 is an enlarged fragmentary perspective view, illustrating when still further is applied to a second point, the front portion is forced sufficiently downwardly into the can, allowing the contents to be freely poured therefrom.

FIG. 6, FIG. 7, and FIG. 8 is a time sequence, illustrating the can opener device in use.

In FIG. 6, the can is in its normal storage condition, in which it is still sealed. No abnormal pressure has been exerted on the first pressure point 44.

In FIG. 7, a finger 50 exerts a downward pressure on the first pressure point 44, breaking the seal of the can at the point 38, and along a portion of the front portion tear edges 36 and the side tear edges 40.

In FIG. 8, pressure is applied by the finger 50 to the top portion 28 at the second pressure point 46. A large portion of the can opener device 24 is pushed into the can 20.

Figure 9:
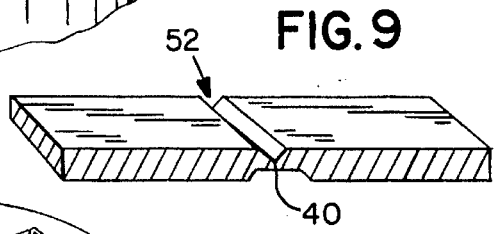
FIG. 9 is a greatly enlarged cross sectional view, taken on line 9—9 of FIG. 2.
Figure 10:
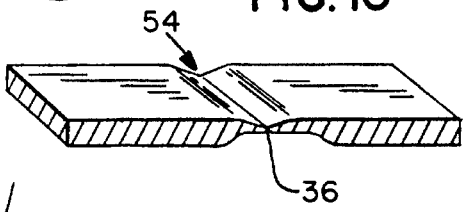
FIG. 10 is a greatly enlarged cross sectional view, taken on line 10—10 of FIG. 2.

FIG. 9 is a cross section of one of the side tear edges 40, and FIG. 10 is a cross section of one of the front portion tear edges 36. The side tear edge 40 has a side tear edge bevel 52, and the front portion tear edge 36 has a front portion tear edge bevel 54.

The side tear edge bevel 52 forms approximately a 90 degree angle, while the front portion tear edge bevel 54 forms a considerably greater angle. With the larger angle of the front portion tear edge bevel 54, the material that forms the front portion tear edge 36 will tend to be thinner, and thus will tear much easier than the side tear edge 40. It is desirable to have the front portion tear edges 36 tear easier than the side portion tear edges 40.

FIGS. 11 and 12 illustrate the mid portion 29 and rear portion 30 when the can is sealed, and then after the can opening operation, respectively.

In FIG. 11, The side tear edge 40 is intact, and the U-bend 45 is not kinked. The mid portion 29 extends above the can top surface 22.

FIG. 12 illustrates the U-bend 45 in the kinked condition after the side tear edge 40 has been severed and the mid portion 29 extends below the can top 22 surface.

FIG. 13, FIG. 14, and FIG. 15 illustrate the rings 32 before the can opening operation, after pressure has been applied to the first pressure point, and after pressure has been applied to the second pressure point.

The rings 32 have thin portions 56 and thick portions 58. Naturally the thin portion 56 has greater flexibility, and bends easier than the thick portion 58. Therefore, the thick portion 58 provides strength, while the thin portion 56 provides flexibility.

FIG. 14 shows a ring near the can opening device after pressure has been applied to the first pressure point. bending has occurred at the thin portion 56, so that the thick portion 58 and the thin portion 56 are in nearly the same plane on the can top 22 surface.

FIG. 15 shows a ring near the can opening device after pressure has been applied to the second pressure point. The ring has been further deformed, and the thin portion 56 has stretched.

The can top 22, as shown in FIG. 2, is comprised of a plurality of rings, for promoting flexibility in the can top 22 to allow for proper operation of the can opening device 24, while maintaining strength and stability.

What is claimed is:

1. A can opener device, for opening a can having a can top, comprising:

a) a front portion formed in the can top, the front portion having at least one front portion tear edge, which can be severed by applying pressure;

b) a top portion attached to the front portion, the top portion in a plane above the can top, the top portion having a second pressure point, where pressure is exerted to push the front portion into the can after the at least one front portion tear edge is severed;

c) a rear portion attached to the top portion, the rear portion having a u-bend, having a first pressure point, where pressure is applied to sever the at least one front portion tear edge; and d) a ring formed in the can top, the ring having a thick portion and a thin portion.

2. The apparatus as recited in claim 1, further comprising side tear edges which extend between the front portion and the rear portion.

3. The apparatus as recited in claim 2, further comprising side portions, extending upward from the side tear edges to the top portion.

4. The apparatus as recited in claim 1, wherein the can top further comprises a plurality of rings.

5. The apparatus as recited in claim 1, wherein the at least one front portion tear edge is two front portion tear edges, the front portion tear edges meeting at a point.

6. The apparatus as recited in claim 1, further comprising a mid portion, extending downward from the top portion to the rear portion.

7. A can opener device, for opening a can having a can top, comprising:

a) a front portion formed in the can top, the front portion having at least one front portion tear edge which can be severed by applying pressure, the at least one front portion tear edge having a front portion tear edge bevel;

b) a top portion attached to the front portion, the top portion in a plane above the can top, the top portion having a second pressure point where pressure is exerted to push the front portion into the can after the at least one front portion tear edge is severed;

c) a rear portion attached to the top portion, the rear portion having a u-bend with a first pressure point where pressure is applied to sever the at least one front portion tear edge; and d) side tear edges extending between the front portion and the rear portion, the side tear edges having a side tear edge bevel, the side tear edge bevel comprising a smaller angle than the front portion tear edge bevel so that the at least one front portion tear edge will tear easier than the side tear edge.

8. The apparatus as recited in claim 7, wherein the can top further comprises a ring, having a thin portion and a thick portion.

9. A can opener device, for opening a can having a can top, comprising:

a) a front portion formed in the can top, the front portion having at least one front portion tear edge which can be severed by applying pressure;

b) a top portion attached to the front portion, the top portion in a plane above the can top, the top portion having a second pressure point where pressure is exerted to push the front portion into the can after the at least one front portion tear edge is severed;

c) a rear portion attached to the top portion, the rear portion having a u-bend with a first pressure point where pressure is applied to sever the at least one front portion tear edge;

d) side tear edges extending between the front portion and the rear portion;

e) side portions extending upward from the side tear edges to the top portion; and f) a ring formed in the can top, the ring having a thick portion and a thin portion.

10. The apparatus as recited in claim 9, wherein the can top further comprises a plurality of rings.

11. The apparatus as recited in claim 10, comprising two front portion tear edges, the front portion tear edges meeting at a point.

12. The apparatus as recited in claim 11, further comprising a mid portion, extending downward from the top portion to the rear portion.

13. The apparatus as recited in claim 12, wherein the two front portion tear edges have a front portion tear edge bevel and the side tear edges have a side tear edge bevel, the side tear edge bevel comprising a smaller angle than the front portion tear edge bevel so that the front portion tear edge will tear easier than the side tear edge bevel.

* * * * *